US006395116B1

(12) United States Patent
Mathis, Sr.

(10) Patent No.: US 6,395,116 B1
(45) Date of Patent: May 28, 2002

(54) METHOD FOR MANUFACTURING COUNTER TOP EDGING FROM FLOOR TILE

(76) Inventor: Kenneth E. Mathis, Sr., 2637 E. Greenway Rd., Phoenix, AZ (US) 85032

( * ) Notice: Subject to any disclaimer, the term of this patent is extended or adjusted under 35 U.S.C. 154(b) by 0 days.

(21) Appl. No.: 09/632,725

(22) Filed: Aug. 4, 2000

(51) Int. Cl.[7] ..... E04B 1/12

(52) U.S. Cl. ..... 156/71; 52/264; 52/245; 52/716.1; 52/176.8; 264/152; 264/261

(58) Field of Search ..... 156/71, 264, 266, 156/245; 264/152, 261, 265; 52/749.11, 716.8, 747.11, 742.16, 745.21, 716.1, 717.05

(56) References Cited

U.S. PATENT DOCUMENTS 3,430,333 A * 3/1969 Hodgen ..... 264/152
3,620,703 A * 11/1971 Evans ..... 156/182
4,083,821 A 4/1978 Harris
4,228,912 A * 10/1980 Harris et al. ..... 220/4 R
4,246,222 A * 1/1981 Monthony ..... 264/219
4,771,488 A 9/1988 Markham
4,789,416 A * 12/1988 Ford ..... 156/222
4,927,481 A * 5/1990 McGregor ..... 156/245
5,253,932 A 10/1993 Nesovic
5,362,349 A * 11/1994 Zoller ..... 156/242
5,494,548 A * 2/1996 Baca ..... 156/265
5,627,231 A 5/1997 Shalov et al.
5,832,913 A 11/1998 Arends
5,865,929 A * 2/1999 Sing ..... 156/264
5,881,786 A * 3/1999 Wilderman et al. ..... 144/348
5,976,670 A 11/1999 Fugazzi

* cited by examiner

*Primary Examiner*—Carl D. Friedman
*Assistant Examiner*—Phi Dieu Tran A
(74) *Attorney, Agent, or Firm*—Frank J. McGue

(57) ABSTRACT

A method is disclosed for using floor tiling to make edging for counter tops. The first step is to cut a floor tile into a plurality of slats. A jig is provided which has a laterally extending, upwardly open recess comprising a plurality of sides having widths corresponding to the widths of the plurality of slats. The plurality of slats are positioned face down into the plurality of sides thereby forming an upwardly facing trench. The plurality of slats are glued together and then the trench is filled with a mortar thereby forming a flat cementitious rearward face to form an edging piece. The edging piece is removed from the jig and then adhered to the edge of a counter top base.

9 Claims, 2 Drawing Sheets

METHOD FOR MANUFACTURING COUNTER TOP EDGING FROM FLOOR TILE

TECHNICAL FIELD

This invention relates to edging for counter tops, and, more particularly, for manufacturing edging for counter tops using floor tiles.

BACKGROUND OF THE INVENTION

For various reasons, floor tiling which is generally blocks or sheets of natural stone or granite, or synthetic stone or ceramic tiling also makes excellent counter tops for work surfaces for kitchens and bathrooms. The durability and cost effectiveness of floor tiling as used in counter tops is unmatched. In addition, the use of floor tiling as a counter top has aesthetic advantages in allowing the user to mix and match the floor tile with counter top tile as desired.

However, presently use of floor tiling for such counter tops require the use of specialized hand work by expensive craftsmen to create aesthetically pleasing edging for use in conjunction with such materials. The result is usually squared edging which may not maximize the aesthetic possibilities of floor tiling.

There have been some attempts in the prior art to provide edging in a more economical manner.

U.S. Pat. No. 5,253,932 entitled "Modular Countertop System" which issued on Oct. 19, 1993 to Nesovic discloses a elongated preformed edging having a rear extending tongue which fits into a corresponding recess in a flat unedged surface supporting sheet.

U.S. Pat. No. 5,976,670 entitled "Solid Surface Composite and Method of Production" which issued on Nov. 2, 1999 to Fugazzi discloses the construction of composites useful as horizontal surfaces. A solid surface material (SSM) preform is made and a substrate of fiber reinforced concrete (FRC) is poured into the preform Counter tops can be made by this process.

U.S. Pat. No. 5,832,913 entitled "Tile Saw Accessory" which issued on Nov. 10, 1998 to Arends shows a tile saw accessory which allows angled cuts on both ceramic and other man-made tile. The related tile is popular as covering surfaces for floors and counter tops.

U.S. Pat. No. 5,627,231 entitled "Decorative Floor Coverings Having the Appearance of Ceramic Tile and Compositions and Methods for Making Same" which issued on May 6, 1997 to Shalov et al. mentions that multi layered sheeting, while designed for use as floor coverings, can be used for a variety of products such as counter top surfaces.

U.S. Pat. No. 4,083,821 entitled "Decorative Non-Vinyl Surface Covering Compostion" which issued on Apr. 11, 1978 to Harris mentions that the claimed composition can be used to cover floor surfaces or counters.

None of known prior art disclose the method set forth herein.

SUMMARY OF THE INVENTION

It is one object of the present invention to provide a method of manufacturing edging which allows the use of existing floor tiling for counter top edging.

It is another object of the invention to provide a method for edging counter tops which allows the user to use floor tiling for counter tops thereby allowing the user to match the counter top to the flooring and provides a durable, cost effective counter top.

Further objects and advantages will become apparent from a consideration of the ensuing description and drawings.

DESCRIPTION OF THE PREFERRED EMBODIMENT

In accordance with the present invention, a floor tile 10 is cut in slats 12 by, in the preferred embodiment, a circular saw (not shown). In the illustrated embodiment, slats 12 are all equal width. However, those skilled in the art will recognize that varying widths are possible if needed for a specialized job. One key to the present method is that cutting slats 12 from an existing tile 10 means that the slats 12 will match exactly said tile 10 in both appearance and length.

Figure 1:
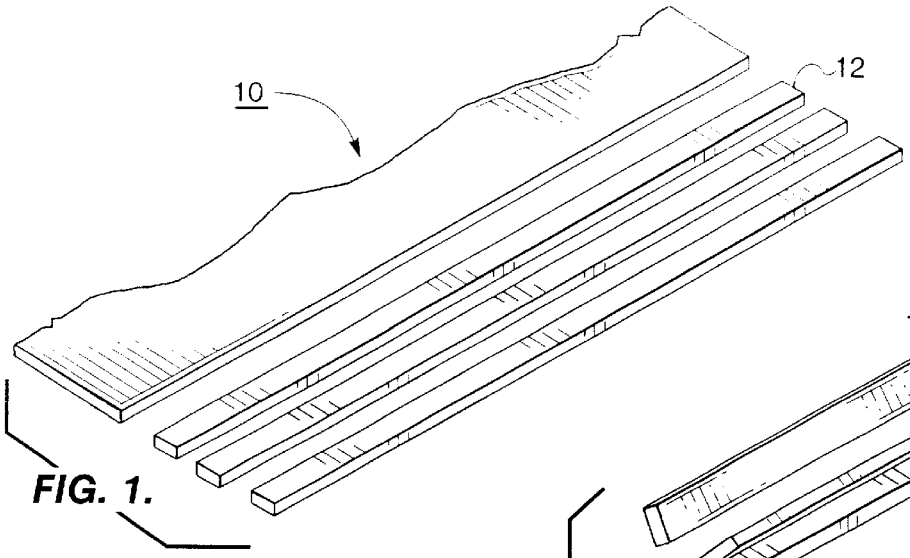
FIG. 1 is a perspective view of a floor tile showing cut tile slats.
Figure 2:
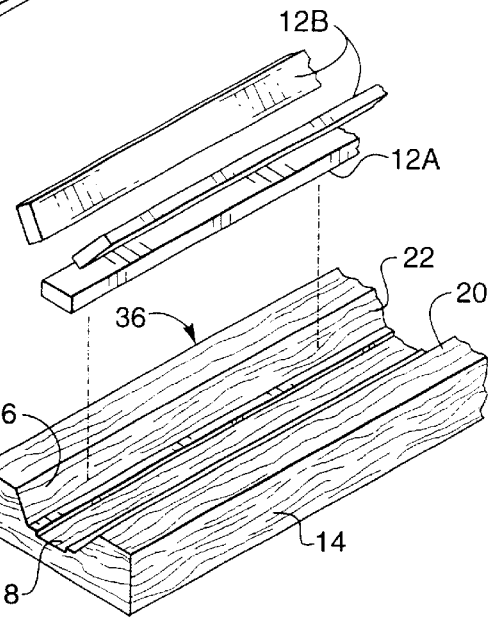
FIG. 2 is a perspective view showing the cut slats of FIG. 1 being placed within a jig.
Figure 3:
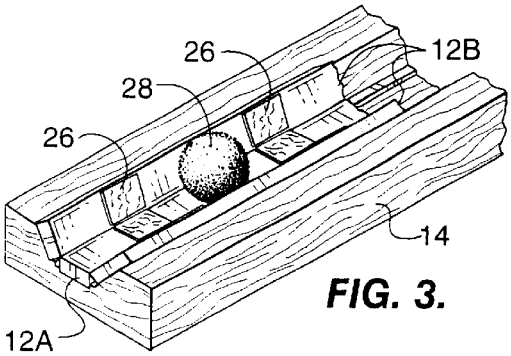
FIG. 3 is a perspective view showing the cut slats in the jig with adhesive layers applied thereto.
Figure 4:
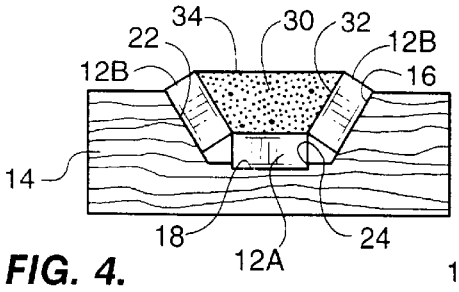
FIG. 4 is a cross section view showing the cut slats in the jig with mortar.

Turning now to FIGS. 2–4, a jig 14 is provided. In the illustrated embodiment, jig 14 is manufactured from wood. However, the invention is not limited to such a material, and other materials such as metals or plastics are certainly within the scope of the invention.

As best seen in FIG. 4, jig 14 is provided with a recess 16 having a with a particularly designed cross section. In the illustrated embodiment, that cross section is trapezoidal with a bottom 18 being parallel to a top surface 20 of jig 14. In the illustrated embodiment, sides 22 are of equal length and extend upwardly at an obtuse angle, in the illustrated embodiment 135°, from bottom 18 to top surface 20. In the illustrated embodiment, a notch 24 is centered in bottom 18 and corresponds in width to slats 12.

Three slats 12 are placed into jig 14 as shown in FIGS. 2–4 with a slat 12*a* corresponding to notch 24 fitting snugly therein with two side slats 12*b* resting upon bottom slat 12*a*. As shown in FIG. 3, two or more adhesive layers 26 are applied to slats 12 within jig 14 and allowed to dry or cure. Sometimes the drying of adhesive layer 26 pulls slats 12*b* from sides 22 as layer 26 cures. To prevent such a pulling, a rubber ball 28 may sometimes be placed between slats 12 as shown in FIG. 3. Adhesive layers 26 are preferably made from commercially available products such as a polyester resin available from CMI mixed with a thickener silica from Degussa Corporation at a 2/3 to 1/3 by volume ratio.

Figure 5:
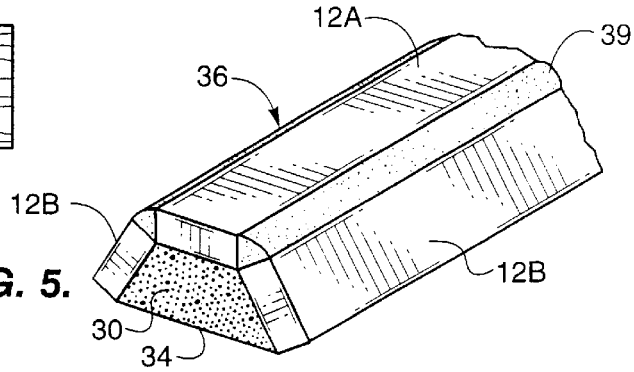
FIG. 5 is a perspective inverted view of the edging removed from the jig with grouting.

Once adhesive layer 26 is cured, a cementitious mortar 30 is added to fill in a trench 32 now formed by slats 12 in jig 14. Mortar 30 provides a flat surface 34 between slats 12*b* as seen in FIG. 4. Once mortar 30 is set, a completed edging piece 36 is removed from jig 14 and is shown in FIG. 5. At the joints between side slats 12*b* and bottom slat 12*a* opposite trench 32, v-shaped grouting slots 38 are created. Slots 38 are generally not filled with grout 39 until the job site.

It will be understood that the exact shape of recess 16 is for purposes of illustration only and that other shapes are certainly contemplated. For example, if the user desires a more gradual edge, a recess having more than three sides, inter alia four or five sides, is certainly within the scope of the present invention. If the user wants a sharper edging, a triangular recess having two sides can be built. The present invention is not meant to be limited to the illustrated embodiment.

Figure 6:
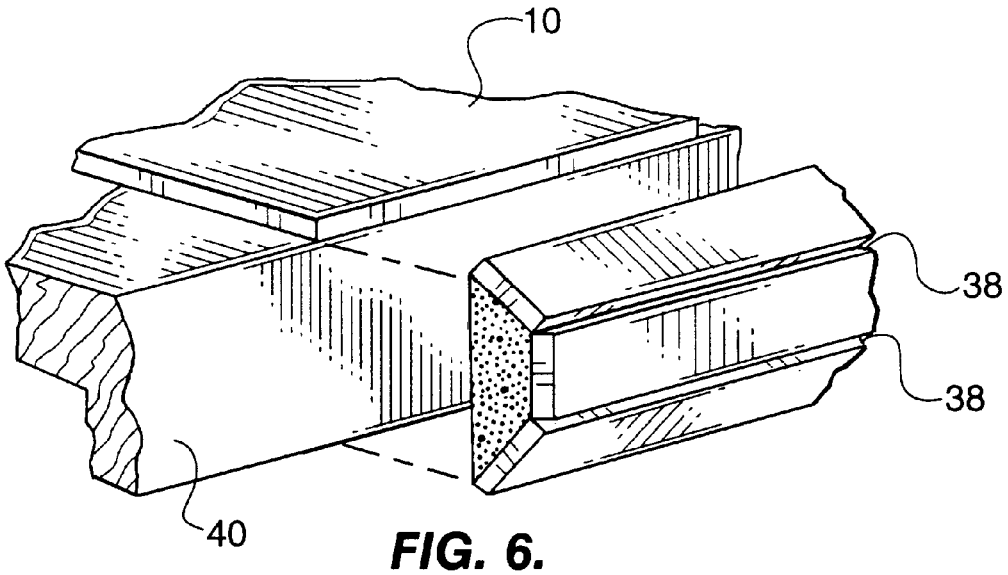
FIG. 6 is a perspective view showing the edging being installed on a counter top.

As best seen in FIG. 6, edging piece 36 is attached to the edge of a counter top base 40 as illustrated. Edging piece 36 is attached using commercial tile adhesives which are well known in the art and will not be further discussed herein. It should again be specifically noted that since edging piece 36 is cut from tile 10, edging piece 36 matches the length of said tile 10 thereby providing easy installation on straight portions of the countertop.

Figure 7:
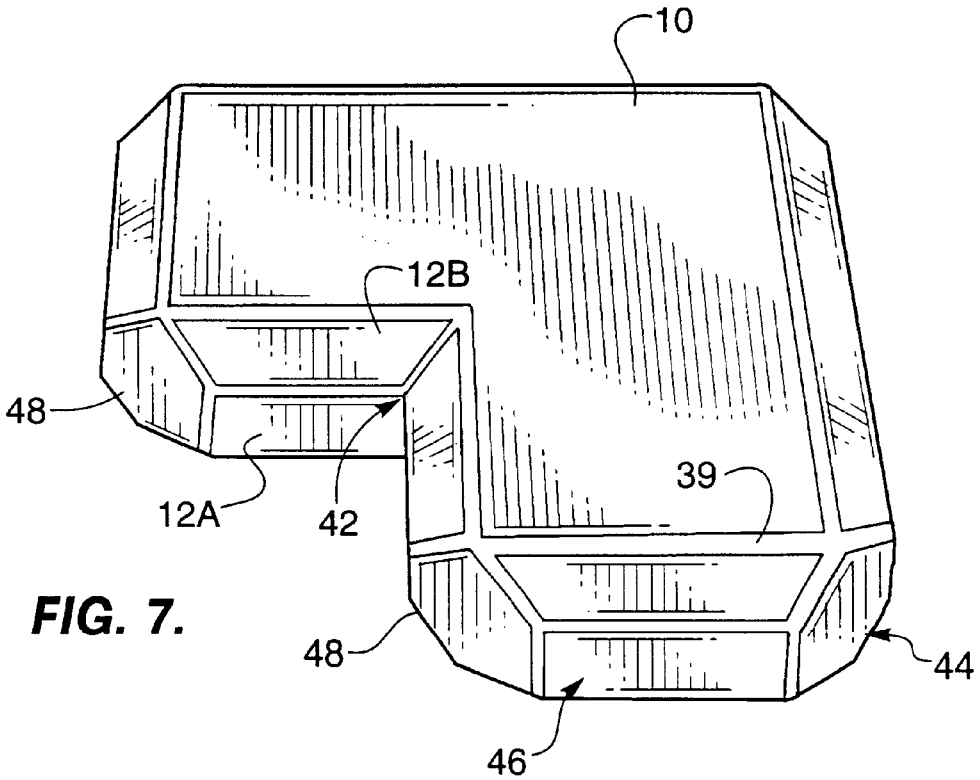
FIG. 7 is a perspective view of a sample piece illustrating the use of the edging is used in flats, inside corners and outside corners.

The method handles both an inside corner 42 and an outside corner 44 as illustrated in FIG. 7. To do either corner 42 or 44, both side slats 12*b* of an edging piece 36 are cut from the end inwardly and towards the middle of edging piece 36 at about a 45 degree angle. Once the cut reaches bottom slat 12*a*, the cut is made laterally across bottom slat 12*a*, This creates a corner edging piece 46. When two corner edging pieces 46 are joined at their cut edges at 90 degree inside corner 42 (i.e. slats 12 of corner edging pieces 36 face one another), the respective cuts meet in an aesthetically pleasing manner.

As also shown in FIG. 7, when two such edging pieces 46 are joined at their cut edges at 90 degree angle outside corner 44 (i.e. mortar 30 of corner edging pieces face 46 face each other) a hexagonal shaped corner piece 48 is used to fill the gap therebetween in an aesthetically pleasing manner. Once the edging 36 and 46 is set in place, grout 39 is applied to finish the task. Application of grout 39 at the job site is preferred to allow for color matching of grout 39.

Thus the scope of the invention should be determined by the appended claims and their legal equivalents, rather than by the examples given.

What is claimed is:

1. A method for using floor tiling to make edging for counter tops comprises the steps of:

cutting a floor tile into a plurality of slats, providing a jig having a laterally extending, upwardly open recess comprising a plurality of sides adapted to receive the plurality of slats, positioning the plurality of slats face down into the plurality of sides thereby forming an upwardly facing trench corresponding to the upwardly facing recess, gluing the plurality of slats together, mortaring the openly facing rear side of the plurality of sides to form a flat cementitious rearward face thereby forming an edging piece, removing the edging piece from the jig, and adhering the edging piece to the side of a counter top base.

2. The method of claim 1 further comprising the step of cutting the edging piece to create a corner edging piece.

3. The method of claim 1 wherein the plurality of slats are cut from the floor tile using a circular saw.

4. The method of claim 1 wherein the jig has three sides, including a bottom and two sides extending upwardly from the bottom at a angle of 135 degrees.

5. The method of claim 4 wherein the bottom includes a notch which is adapted to receive one of the plurality of slots.

6. The method of claim 4 further comprising the step of providing a rubber ball adapted to rest upon the slats in the recess and prevent said slats from separating from the plurality of sides as the glue dries.

7. The method of claim 1 further comprising the step of grouting the joints between slats.

8. The method of claim 1 further comprising the steps of cutting two edging pieces to form a corner edging piece and mating said corner edging pieces to form an inside corner.

9. The method of claim 1 further comprising the steps of cutting two edging pieces to form a corner edging piece, mating said corner edging pieces to form an outside corner, and providing a corner piece to cover a gap formed between the two corner edging pieces.

* * * * *